United States Patent [19]

Gist

[11] 3,977,722

[45] Aug. 31, 1976

[54] RETRACTABLE CHAIR FOR A TABLE OR THE LIKE

[75] Inventor: Lanny J. Gist, Bowling Green, Ohio

[73] Assignee: Colorado Leisure Products, Inc., Broomfield, Colo.

[22] Filed: Nov. 4, 1974

[21] Appl. No.: 520,481

[52] U.S. Cl. ..... 297/143; 248/226 C; 297/378

[51] Int. Cl.[2] ..... A47D 1/10

[58] Field of Search ..... 297/140, 143, 141, 142, 297/174, 134, 135, 378; 248/226 C, 316 B; 108/28

[56] References Cited

UNITED STATES PATENTS

| | | | |
|---|---|---|---|
| 324,234 | 8/1885 | Cole | 108/28 |
| 1,304,368 | 5/1919 | Purcell | 297/143 |
| 1,501,443 | 7/1924 | Ellis | 297/143 |
| 1,606,541 | 11/1926 | Straith | 297/141 |
| 2,540,672 | 2/1951 | Holmes | 297/174 |
| 2,821,241 | 1/1958 | Schwahn | 297/141 |
| 2,956,617 | 10/1960 | Bruderer | 297/141 |
| 3,126,226 | 3/1964 | Johnson | 297/174 |
| 3,195,949 | 7/1965 | Mix | 297/140 |

*Primary Examiner*—James T. McCall

[57] ABSTRACT

A retractable babies' or children's chair is provided. The chair has a tubular frame slidably supported in tracks affixed to the underside of a table top. The frame, along with a seat and a back, can be slidably moved between a retracted position under the table top and an extended position protruding beyond the edge of the table to support a child in an eating position. The back is pivotally connected to the seat with the seat being pivotally connected by links to the tubular frame. The back has hooks which can be engaged with the frame to hold the back and the seat in a fixed position relative to the frame. When the frame is under the table top, the seat and the back are pivotally swung up to a position adjacent the frame so as not to interfere with knee room under the table. The frame has supporting clips which hold the seat in the adjacent position when under the table. The frame is equipped with safety catches which automatially hook over the edge of the table when in the extended position. The safety catches are locked in place by latches which must be manually released before the frame and seat are moved back to the retracted position.

8 Claims, 11 Drawing Figures

RETRACTABLE CHAIR FOR A TABLE OR THE LIKE

This invention relates to a retractable chair and particularly to a retractable high chair for babies and small children.

The new retractable chair is supported under a table, specifically by a supporting unit affixed to the bottom surface of the table top, which unit movably supports the frame of the chair so that the chair can be moved from a retracted, stored position in which it is totally under the table top to an extended position in which it protrudes beyond the table top, so that a seat thereof is exposed. The child can be placed on the seat and is then in an eating position relative to the table top. With this arrangement, there is no need for a separate special tray as is commonly used with a high chair and the seat is always at the proper position relative to the table top even for tables of various heights. Further, there is no danger of the child tipping over the chair as is possible with a high chair. A particular advantage is the fact that when the chair is in the retracted position, it does not consume any extra useable space at all. This is in sharp contrast to the common high chair which consumes considerable floor space, which can be a particular disadvantage in smaller homes, mobile homes, camping trailers, etc. Not only is the consumption of floor space eliminated, but the new chair is not in the way when the floor is to be cleaned or waxed. The new retractable chair is also less expensive than most high chairs which require a sizable stand along with a tray and other accessories.

The retractable chair includes supporting means affixed to the underside of the table top and having a pair of tracks extending toward an edge thereof. Legs of a chair frame disposed in a horizontal plane are slidably supported by the tracks and the frame can be moved from a retracted position below the table top to an extended position. The frame pivotally supports a seat on which a seat back is pivotally mounted with both being foldable so as to be moved up adjacent the frame when in the retracted position. In that position, the frame has supporting clips which hold the seat and back adjacent the frame. When the chair is extended, the seat back has hooks which connect with a portion of the frame to hold the seat and back in a fixed position relative to the frame. The frame also is equipped with safety catches which hook over the table edge when the frame is in the extended position to provide additional support for the frame relative to the table. The safety catches automatically swing into position when the frame is extended and lock in that position. The latches for the safety catches must both be released and the seat and frame pushed toward the retracted position at the same time to swing the catches out of the way. This renders it virtually impossible for a child to inadvertently release the safety catches.

It is, therefore, a principal object of the invention to provide an improved retractable chair for babies or small children which can be supported directly by a table top and which can be moved between a retracted, stored position under the top and an extended, operable position beyond an edge of the top.

Another object of the invention is to provide a retractable chair of the type described having a frame pivotally supporting a seat and back with the back being releasably connectable to the frame to hold the seat and back in a fixed position relative to the frame.

A further object of the invention is to provide a retractable chair of the type described having a frame equipped with automatically moved catches to support the frame relative to the table top when the frame is moved to an extended position.

Yet a further object of the invention is to provide a retractable chair having safety catches which lock by latches when moved into position and must be individually released.

Still another object of the invention is to provide a retractable chair having supporting clips for holding a seat and back adjacent the frame when the seat is in a stored position.

Many other objects and advantages of the invention will be apparent from the following detailed description of a preferred embodiment thereof, reference being made to the accompanying drawings, in which.

Figure 1:
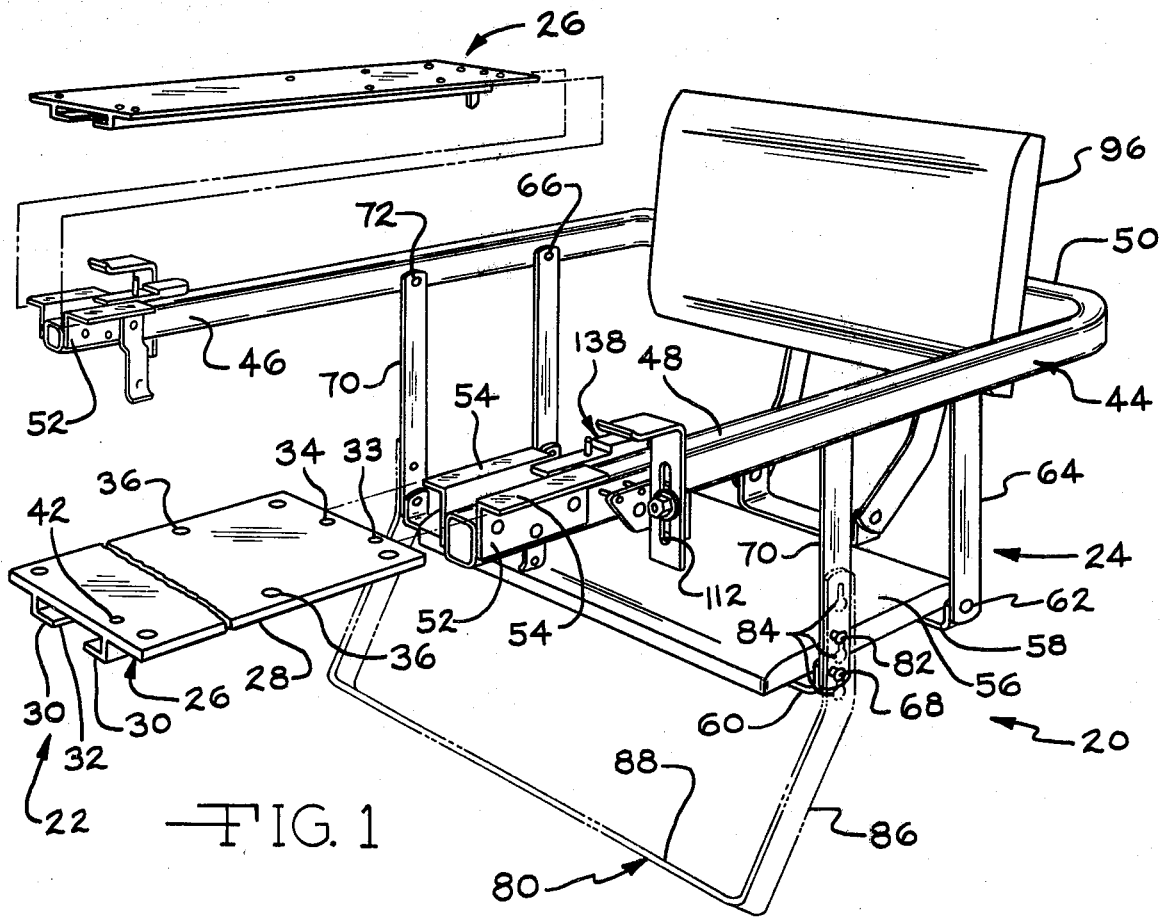
FIG. 1 is a view in perspective of a chair embodying the invention shown in an extended position with supporting means shown spaced from a seating assembly.
Figure 2:
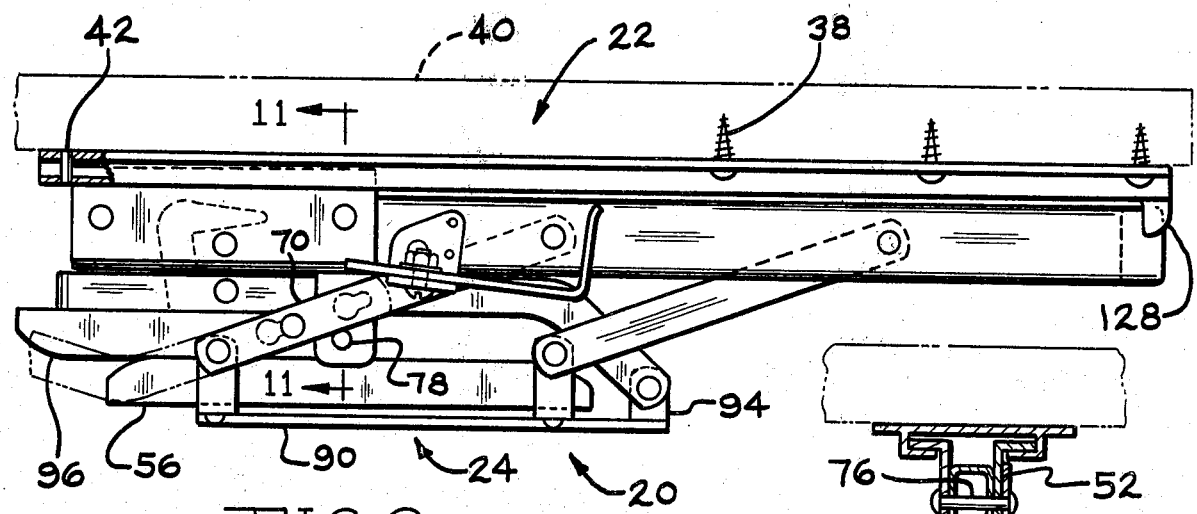
FIG. 2 is a side view in elevation of the chair in a retracted, stored position relative to a table top shown in dotted lines.

Referring to FIGS. 1 and 2 in particular, a retractable chair according to the invention is indicated at 20 and includes supporting means indicated at 22 and a seating assembly indicated at 24. The supporting means 22 includes two channel members 26 which are shown as separate components but which could be connected by one or more cross struts to maintain the members in fixed relationship relative to one another. Each of the channel members 26 includes a mounting plate 28 and two L-shaped depending flanges 30 which, in this instance, are structurally integral with the mounting plate 28. The combination of the mounting plate 28 and the two depending flanges 30 form generally C-shaped channels or tracks 32. The mounting plate 28 has a stop pin 33 near the outer end thereof which extends into the track 32. The mounting plate 28 also has a locking hole 34 at the same end, the purpose of which will be discussed subsequently. Near the longitudinal edges of the mounting plate 28 are a plurality of fastener openings 36 which receive screws 38 (FIG. 2) for mounting the channel members 26 on the underside of a table top 40. The inner end of each of the channel members 26 has a stop pin 42 to prevent the seating assembly 24 from being moved beyond its proper retracted position under the table top 40.

The seating assembly 24 includes a U-shaped frame 44 having legs 46 and 48 and a connecting web 50. The frame 44 is made of a tubular member having a rectangular cross-sectional shape with the larger dimension of the rectangle extending vertically to provide maximum stiffness for the frame 44 in a vertical direction. At the free or inner ends of the legs 46 and 48 are generally L-shaped flange members 52 which are fastened, as by rivets, to the ends of the legs 46 and 48 and extend upwardly beyond them, terminating in side flanges 54. The side flanges 54 are received in the tracks 32 and cooperate with the horizontally-extending portions of the flanges 30. With the stop pins 33 and 42 in place, the frame 44 is held in an assembled position relative to the channel members 26 and the chair 20 can be purchased as an assembly to assure that the channel members 26 will be affixed to the underside of table top 40 in the proper position.

A seat 56 of the seating assembly 24 is supported on rear and front cross bars 58 and 60. The rear cross bar 58 is pivotally connected by pins 62 to upright rear links 64 which are pivotally connected at their upper ends by pins 66 to the legs 46 and 48 of the frame 44. The front cross bar 60 is pivotally connected by shoulder pins 68 to upright front links 70 which are parallel to the links 64. The upper ends of the front links 70 are also pivotally connected by pins 72 to the frame legs 46 and 48. In this manner, the support for the seat 56 forms a parallelogram which enables the seat to move from a lower, seating position as shown in FIG. 1 to an upper, stored position adjacent the frame 44, as shown in FIG. 21.

Figure 11:
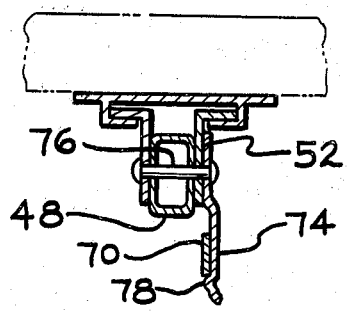
FIG. 11 is a detail view in transverse cross section taken along the line 11—11 of FIG. 2.

When the seat assembly 24 is in the stored position, each of the front links 70 is engaged and held in that position by a resilient supporting clip 74 (FIG. 11) located on the inner surface of one of the flange members 52 and affixed to the frame leg 46 or 48 by pins or rivets 76. The supporting clip 74 has an outwardly facing projection 78 which extends under the lower edge of the link 70.

A foot rest 80 can be mounted on the seat assembly 24 and specifically on lower portions of the front links 70. As shown in FIG. 1, the lower ends of the links 70 have upper shoulder pins 82 which are received in key hole openings 84 in upper portions of legs 86 of the foot rest 80. There are three or more of the openings 84 in the legs 86 to provide a degree of adjustment for a horizontal leg 88 of the foot rest extending between the upright legs 86. By employing the two pins 68 and 82 on the front links 70, the foot rest 80 and specifically the horizontal leg 88 cannot pivot or swing relative to the seat 56.

Figure 4:
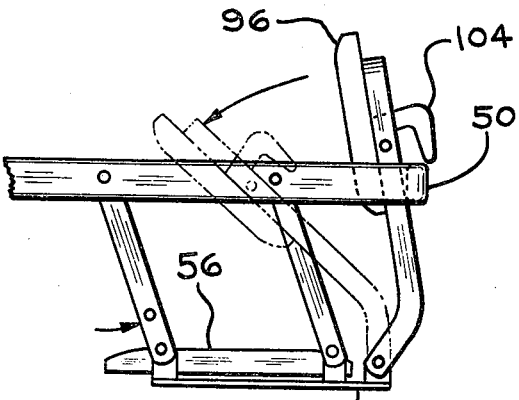
FIG. 4 is a fragmentary side view in elevation of the seating unit showing the manner in which the seat back is connected to the frame.
Figure 3:
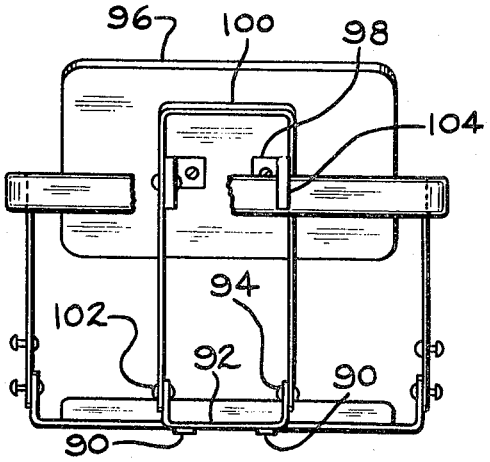
FIG. 3 is a rear view in elevation, with parts broken away, of the chair of FIG. 1.

As shown in FIGS. 2–4, two lower bars 90 extend perpendicular to the cross bars 58 and 60 and are suitably affixed thereto, as by spot welding. The lower bars 90 extend beyond the rear edge of the seat 56 and have mounted thereon a connecting bar 92 having up-turned ears 94. A seat back 96 has two rearwardly-extending connecting flanges 98 to which are affixed in inverted U-shaped connecting strap 100 having lower ends pivotally connected by pins 102 to the ears 94, which enable the seat back 96 to pivot relative to the seat 56. The legs of the connecting strap 100 are curved near the lower ends so that the back 96 can be folded parallel to and substantially contiguous with the seat 56 when in the retracted, stored position of FIG. 2. The flanges 98 not only connect the seat back 96 to the strap 100 but extend beyond the strap and terminate in hooks 104. These hooks are shaped to fit over the web 50 of the frame 44 and thereby hold the seat 56 and the back 96 in fixed positions relative to the frame 44. At the same time, the seat and back are freely pivotable relative to the frame so as to be readily manipulated between the lower and upper positions. In order to place the hooks 104 over the web 50, the seat 56 is swung outwardly beyond the lower, seating position to raise the seat and back above the lower position and place the hooks 104 above the web 50, as shown in FIG. 4. With the hooks 104 over the web 50, the seat 56 is swung back to the lower position to engage the hooks with the web.

The chair 20 is provided with safety catches which automatically engage the edge of the table top 40 and lock in position when the seating assembly 24 is moved to the extended, operable position. Further, the catches, when in place, must be individually released and the seat assembly pushed in at the same time in order to move the seat assembly 24 back to the retracted position. This renders it virtually impossible for the child to inadvertently move the catches from their supporting positions.

Figure 9:
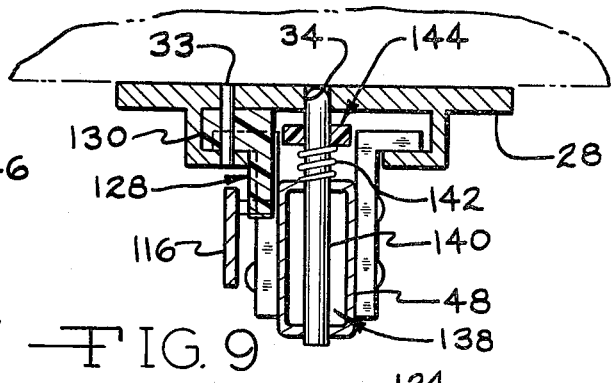
FIG. 9 is a view in cross section, taken along the line 9—9 of FIG. 8.
Figure 7:
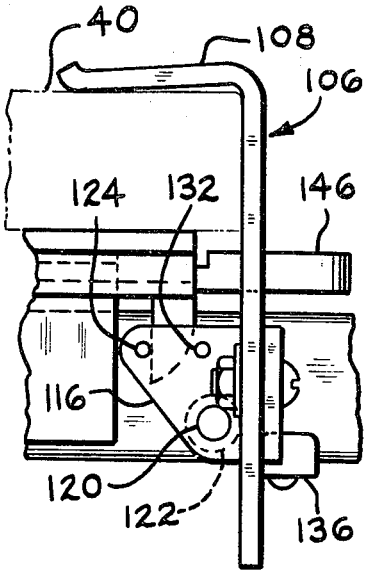
FIGS. 5–7 are enlarged, fragmentary side views in elevation of a safety catch shown in different positions relative to the table top as a frame of the seating unit is moved to the extended position.
Figure 6:
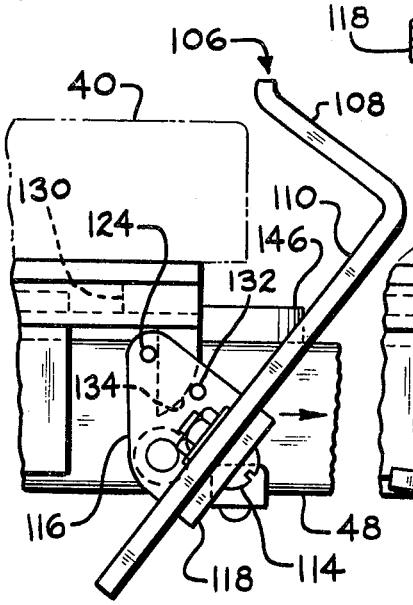
Figure 5:
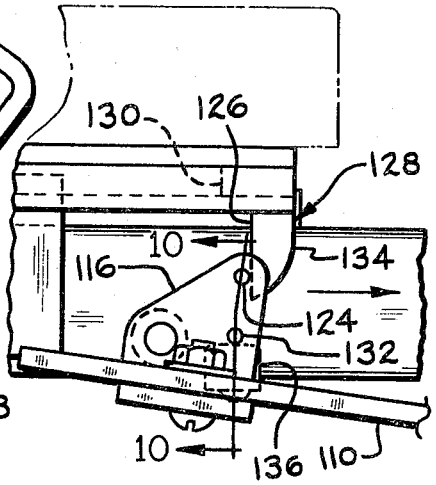

Referring to FIGS. 5–7, a safety catch 106 is carried by each of the legs 46 and 48. The catch includes a horizontally-extending leg 108 which engages the upper surface of the table top 40 and an upright leg 110 having a slot 112 (FIG. 1) through which a fastener 114 extends to adjustably connect the leg 110 to a pivotal cam plate 116 having an outwardly-extending flange 118 through which the fastener 114 extends. This adjustment enables the catch to be properly positioned for different table top thicknesses. The cam plate 116 is pivotally supported by the frame leg 48 through a pin 120, with the cam plate being spaced from the adjacent surface of the leg 48 by a plastic spacing sleeve 122. The cam plate 116 has a first pin 124 extending perpendicularly therefrom toward the frame member. As the seating assembly 24 is pulled outwardly toward the extended position, as shown in FIG. 5, the pin 124 engages an inner straight surface 126 of a depending cam flange 128 which extends downwardly from the channel member 26. As shown in FIG. 9, the cam flange 128 has a transversely-extending body 130 which is located in a side portion of the track 32 and is held by the stop pin 33 so that the flanges 54 actually are stopped by the body 130 when the seating assembly 24 is moved outwardly.

Figure 10:
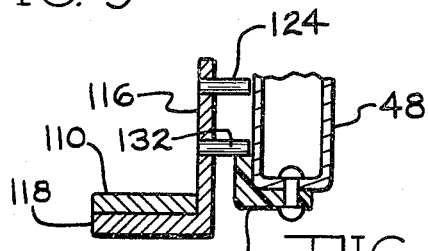
FIG. 10 is a fragmentary view in transverse cross section taken along the line 10—10 of FIG. 5.

Referring to FIGS. 5–7, during the outward movement of the assembly, the pin engagement of the first pin 124 with the straight edge 126 of the cam flange 128 causes the cam plate 116 and the safety catch 106 to move in a counter clockwise direction to cause the leg 108 to move over and into engagement with the top 40. The cam plate 116 has a second pin 132 which engages a curved edge 134 of the cam flange 128 when the seat assembly is pushed inwardly toward the retracted position. This forces the safety catch 106 downwardly in a clockwise direction during the inward movement, with the second pin 132 hitting a stop member 136 affixed to the leg 48, as shown in FIGS. 5 and 10. The two pins 124 and 132 in cooperation with the cam flange 128 enable positive, controlled movement of the safety catch 106 in both directions.

Figure 8:
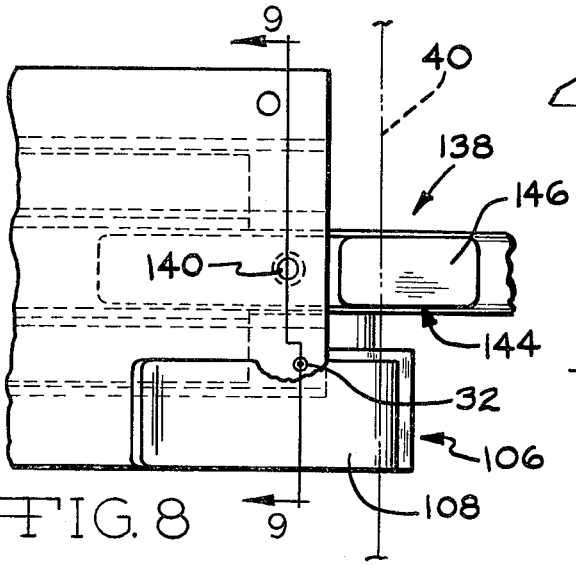
FIG. 8 is an enlarged, fragmentary plan view of a portion of a supporting track constituting part of the supporting means for the seating assembly.

Each of the legs 46 and 48 has a safety latch which locks the seat assembly 24 in the extended position. As shown in FIGS. 1, 8, and 9, a safety latch indicated at 138 includes a vertical locking pin 140 (FIG. 9) which extends vertically through the frame leg 46 or 48. A coil spring 142 is located around the pin 140 above the frame leg 48 and below a release lever 144 which is suitably affixed to the pin 140 above the spring 142. The release lever 144 has a thumb pad 146 (FIG. 8) which can be pushed downwardly by one thumb of a person while the corresponding lever on the other frame leg 46 is similarly pushed down by the other thumb, with both hands engaging the frame legs 46 and 48 at the same time to push it inwardly. When the levers are pushed downwardly, the pins 140 move downwardly as the forces of the springs 142 are overcome to release the upper ends of the pins from the locking holes 34 and the mounting plate 28. As the seat assembly 24 is moved inwardly beyond the holes 34, the upper ends of the pins 140 then simply ride against that portion of the surface of the mounting plate 28 in the track 32. When the seat assembly is again moved to the extended position with the flanges 54 engaging the bodies 130 of the cam flanges 128, the pins 140 will again snap into the locking holes 34 to prevent further movement of the frame 44 in either direction relative to the channel members 26 until the pins are again released. Since both of the levers 144 must be pushed downwardly at the same time and the frame 44 pushed inwardly toward the retracted position simultaneously with the depression of the levers, a child cannot inadvertently release the pins and push the frame 44 slightly inwardly a distance sufficient to disengage the safety catches 106 from the table top 40. Hence, as long as the seat is occupied, the safety catches 106 are in position to provide additional support for the chair 20.

Various modifications of the above-described embodiment of the invention will be apparent to those skilled in thhe art and it is to be understood that such modifications can be made without departing from the scope of the invention, if they are within the spirit and the tenor of the accompanying claims.

I claim:

1. A retractable chair for small children comprising a seat, means connected to said seat for supporting said seat from a table and for enabling said seat to be moved relative to the table between an extended, operable position and a retracted, stored position, said connecting means including a frame and track means attachable to the bottom surface of a top of the table for slidably supporting said frame, catch means for providing additional support for said seat from said table when said seat is in the extended, operable position, said catch means comprising an L-shaped catch pivotally supported by said frame and a cam plate associated with said track means and engageable with said catch to move said catch between the supporting position relative to the table top and a position spaced from the table top, and latch means for holding said seat in a fixed position relative to the table when in the extended position and to maintain said catch means in the supporting position relative to said table.

2. A chair for small children comprising supporting means adapted to be located below a top of a table and to be supported by same, and a seat assembly comprising a frame engageable with said supporting means, a seat pivotally carried by said frame through parallel links pivotally connected to both said seat and said frame, a seat back pivotally carried by said seat, and means releasably connecting said seat back to said frame to hold said seat and said back in a fixed position relative to said frame.

3. A chair for small children comprising supporting means adapted to be located below a top of a table and to be supported by same, and a seat assembly comprising a frame engageable with said supporting means, said frame having two legs, each of said legs pivotally carrying a safety catch, and cam means for moving said catch between a position engageable with the table top and a position spaced from the table top, a seat pivotally carried by said frame, a seat back pivotally carried by said seat, and means releasably connecting said seat back to said frame to hold said seat and said back in a fixed position relative to said frame.

4. A chair for small children comprising supporting means adapted to be located below a top of a table and to be supported by same, and a seat assembly comprising a frame engageable with said supporting means, a seat pivotally carried by said frame through pivotal links, supporting clips carried by said frame for engaging and holding at least two of said links when said seat is pivoted to an upper position adjacent said frame, a seat back pivotally carried by said seat, and means releasably connecting said seat back to said frame to hold said seat and said back in a fixed position relative to said frame.

5. A retractable chair for small children comprising a seat, means connected to said seat for supporting said seat from a table and for enabling said seat to be moved relative to the table between an extended, operable position and a retracted, stored position, said means including a frame and track means attachable to the bottom surface of a top of the table for slidably supporting said frame, and latch means for holding said seat in a fixed position relative to the table when in the extended position, said latch means comprising an opening in said track means near an outer end portion thereof, a locking pin carried by said frame, resilient means connected with said locking pin and urging said pin toward said opening, and manually-operable means for releasing said locking pin from said opening.

6. A retractable chair according to claim 5 characterized by catch means for providing additional support for said seat from said table when said seat is in the extended, operable position, said catch means having means for releasing said catch means from said table when the seat is moved back toward the retracted position.

7. A retractable chair according to claim 5 characterized by said frame having two legs, and there being one of said locking pins carried by each of said legs.

8. A chair according to claim 3 characterized further by each of said frame legs having a latch engageable with said supporting means when said frame and seat are in an extended position beyond the table top for holding said frame and seat in the extended position.

* * * * *